US007637682B2

(12) United States Patent
To

(10) Patent No.: US 7,637,682 B2
(45) Date of Patent: Dec. 29, 2009

(54) RING BINDER

(75) Inventor: Chun Yuen To, New Territories (CN)

(73) Assignee: World Wide Stationery Manufacturing Company Limited, New Territories, Hong Kong (CN)

( * ) Notice: Subject to any disclaimer, the term of this patent is extended or adjusted under 35 U.S.C. 154(b) by 0 days.

(21) Appl. No.: 12/206,030

(22) Filed: Sep. 8, 2008

(65) Prior Publication Data

US 2009/0067915 A1 Mar. 12, 2009

(30) Foreign Application Priority Data

Sep. 12, 2007 (CN) ..... 2007 1 0148944

(51) Int. Cl.
*B42F 13/20* (2006.01)

(52) U.S. Cl. ..... 402/38; 402/19; 402/26; D19/27

(58) Field of Classification Search ..... 402/19, 402/26–45, 70, 73, 80 R; D19/26, 27, 32
See application file for complete search history.

(56) References Cited

U.S. PATENT DOCUMENTS

| | | | | | |
|---|---|---|---|---|---|
| 724,849 | A * | 4/1903 | Gresham | ..... | 402/56 |
| 1,927,802 | A * | 9/1933 | McMillan | ..... | 402/32 |
| 3,995,961 | A * | 12/1976 | Dorfman et al. | ..... | 402/38 |
| 4,214,839 | A * | 7/1980 | Sheehan et al. | ..... | 402/31 |
| 5,106,222 | A * | 4/1992 | D'Amore | ..... | 402/26 |
| 6,328,497 | B1 * | 12/2001 | To | ..... | 402/26 |
| 6,536,980 | B2 * | 3/2003 | To | ..... | 402/26 |
| 6,558,064 | B1 * | 5/2003 | Tibbetts | ..... | 402/80 R |
| D529,957 | S * | 10/2006 | Shimada et al. | ..... | D19/32 |
| 7,360,962 | B2 * | 4/2008 | To | ..... | 402/39 |
| 2005/0207826 | A1 * | 9/2005 | Cheng et al. | ..... | 402/31 |
| 2007/0086836 | A1 * | 4/2007 | Cheng | ..... | 402/37 |

* cited by examiner

*Primary Examiner*—Dana Ross
*Assistant Examiner*—Jamila Williams
(74) *Attorney, Agent, or Firm*—Marshall, Gerstein & Borun LLP

(57) ABSTRACT

A ring binder for retaining hole-punched pages comprises a housing, a pair of pivotable hinge plates received in the housing, and at least one pair of half ring members fixed to the hinge plates and moved between a closed position and an open position. Each of the half ring members comprises an anchoring portion fixed to a corresponding hinge plate, a transverse arm portion connected to the anchoring portion and extending outwardly in a transverse direction, an oblique arm portion connected to the transverse arm portion and extending obliquely and upwardly, and a curved portion connected to the oblique arm portion and extending upwardly and inwardly. In the closed position, upper ends of the curved portions of the pair of half ring members abut against each other in a face to face manner, and the opposite curved portions form an upwardly directed arc.

28 Claims, 15 Drawing Sheets

30
40
50

26
28
20
22
14
14
30
40
60

30
50
60

16
12
10
40
30
60

30
40

20
22
14
30
14
40

30

40
10
30

RING BINDER

REFERENCE TO RELATED APPLICATION

This application claims priority to China application No. 200710148944.3, filed on Sep. 12, 2007.

TECHNICAL FIELD

The invention relates to a ring binder for retaining hole-punched pages.

BACKGROUND ART

As is known in the art, a typical ring binder retains loose leaf pages or document papers with hole-punched edges in a file or a notebook. The ring binder generally comprises an elongated housing, a pair of pivotable hinge plates located in the housing and clamped together by the housing, and half ring members fixed to the hinge plates. The housing is relatively highly rigid, but still has certain elasticity so that it can be slightly expanded in a transverse direction by the hinge plates. The hinge plates abut against each other at their inner edges and engage with transversely bent-in edges of the housing at their outer edges. The hinge plates are thus hinged to each other so that they can pivot relative to each other within a certain angle. Each of the hinge plates is fixed with the same number of half ring members at longitudinal locations corresponding to the holes punched along one edge of each of the stacked pages. The half ring members are closed or opened as the hinge plates pivoting. When closed, opposite half ring members provided at the same longitudinal locations on the two hinge plates respectively abut against each other by their tip ends, forming a complete ring for retaining loose-leaf pages. When opened, the tip ends of the opposite half ring members are separated from each other to form an opening therebetween through which loose-leaf pages can be taken out or loaded into the binder. The rings formed by the half ring members in a traditional binder typically have circular, arc, rectangular or other shapes. When the rings have circular, arc or other curved main bodies, the hole-punched edges of the retained pages will follow the curved shape of the half ring members. Thus, the hole-punched edges of the pages cannot align with each other tidily in either open position or closed position. On the other hand, when the rings have rectangular or other straight main bodies, it is difficult to move the pages smoothly when loading them onto the rings or turning them along the rings. When a stack of pages are loaded or turned, they may be jammed or blocked on the rings. Accordingly, there is a need for a ring binder which allows the pages to be tidily aligned with each other and can be loaded and turned smoothly.

SUMMARY OF INVENTION

The present invention is aimed at overcoming the defects existed in the prior art by providing a ring binder for retaining hole-punched pages, by means of which, a stack of loose leaf pages can be retained in a tidily aligned manner and can be loaded and turned easily.

To this end, the present invention provides a ring binder for retaining hole-punched pages comprising a housing extending in a longitudinal direction, a pair of pivotable hinge plates received in the housing and clamped together by the housing, and at least one pair of half ring members fixed to the pair of hinge plates respectively and moved between a closed position and an open position when the hinge plates are pivoted with respect to each other. Each of the half ring members comprises an anchoring portion fixed to a corresponding one of the hinge plates, a transverse arm portion having an inner end connected to an upper end of the anchoring portion and extending outwardly in a transverse direction therefrom, an oblique arm portion having a lower end connected to an outer end of the transverse arm portion and extending obliquely and upwardly therefrom, the oblique arm portion being inwardly inclined in the closed position and outwardly inclined in the open position; and a curved portion having a lower end connected to an upper end of the oblique arm portion and extending therefrom upwardly and inwardly to form an arc section. In the closed position, upper ends of the curved portions of the pair of half ring members abut against each other in a face to face manner, and the opposite curved portions form an upwardly directed arc.

Preferably, the arc section is a circular section or an elliptic section.

Preferably, the arc section is an elliptic section with a radian in the range of 30°~90° or a circular section with a radian in the range of 45°~85°.

Preferably, the two curved portion are provided with engaging structures at their upper ends.

For example, the engaging structures may comprise serrated profiles or stepped profiles which engage with each other.

Alternatively, the engaging structures may comprise a projection formed on the upper end of the curved portion of one of the half ring members and a recess formed in the upper end of the curved portion of the other of the half ring members for receiving the projection therein. In this case, the size of the cross section of the projection, from the front end of the projection to the rear end of the projection, keeps constant or become gradually enlarged, and the size of the cross section of the recess, from the front end of the recess to the rear end of the recess, keeps constant or become gradually reduced.

Preferably, the shape of the projection is selected from a group consisting of: a prism or a cylinder with a chamfered or rounded front end, a circular cone or a prismatic cone gradually enlarged from its front end to its rear end, a semisphere or a part of a sphere, and a semi-spheroid or a part of a spheroid.

The shape of the recess is selected from a group consisting of: a prism, a cylinder, and a circular cone or a prismatic cone gradually reduced from its front end to its rear end.

The oblique arm portion may be straight. The transverse arm portion may also be straight. Alternatively, the transverse arm portion comprises an inner transverse arm section and an outer transverse arm section, the inner transverse arm section is straight and extends outwardly from the anchoring portion, and the outer transverse arm section is contiguous to an outer end of the inner transverse arm section and is inclined outwardly and downwardly with respect to the inner transverse arm section.

Preferably, the inwardly inclined angle of the oblique arm portion in the closed position is smaller than the pivot angle of the half ring member between the closed position and the open position. For example, the inwardly inclined angle of the oblique arm portion in the closed position is one half of the pivot angle of the half ring member. The inwardly inclined angle of the oblique arm portion may be in the range of 5°~45°, preferably in the range of 10°~30°, and most preferably in the range of 15°~25°.

Preferably, there is a smooth transition between the curved portion and the oblique arm portion of the half ring member.

Preferably, an acute angle is formed between the oblique arm portion and the transverse arm portion of the half ring member.

Preferably, a right angle or an acute angle is formed between the transverse arm portion and the anchoring portion of the half ring member.

Preferably, the anchoring portion of the half ring member inserts through an inserting hole formed in a corresponding one of the hinge plates and is anchored thereto, at least one side surface of the anchoring portion is formed with a locating portion, and the inserting hole has a fitting portion which engages with the locating portion of the anchoring portion.

Preferably, the locating portion comprises one or more locating planes. The one or more locating planes are preferably parallel to or perpendicular to the transverse direction.

Preferably, the ring binder further comprises attaching members to be attached to a carrier for the ring binder.

Preferably, the ring binder further comprises actuating levers provided at longitudinal opposite ends of the housing, each actuating lever having a driving portion engaging with inner portions of longitudinal ends of the pair of hinge plates.

Preferably, a top wall of the housing is formed with reinforcement ridges which extend in the longitudinal direction.

Preferably, the housing is formed with transverse cutouts which are inserted through by the half ring members, and is formed with reinforcement ribs extended in the longitudinal direction near the cutouts.

Preferably, the hinge plates are each formed with reinforcement ribs which extend in the longitudinal direction and are separated with each other in the longitudinal direction.

According to the ring binder of the invention, the oblique arm portions of the two half ring members are obliquely orientated (being inwardly inclined in the closed position and outwardly inclined in the open position), thus the edges of a stack of pages retained by the half ring members are aligned tidily. Moreover, the upper portion of each half ring member is formed as a curved portion, with opposite curved portions forming an arc, thus the pages are easy to be loaded and turned from one of the half ring members to the other of the half ring members, without any impeding when turning. In addition, the inclination of the oblique arm portion is not too large in either the closed position or the open position, the tidiness of the stack of pages will not be significantly affected when the oblique arm portion is pivoted from the closed position to the open position.

DETAILED DESCRIPTION OF THE PREFERRED EMBODIMENTS

Figures 1A, 1B, 1C, 1D:
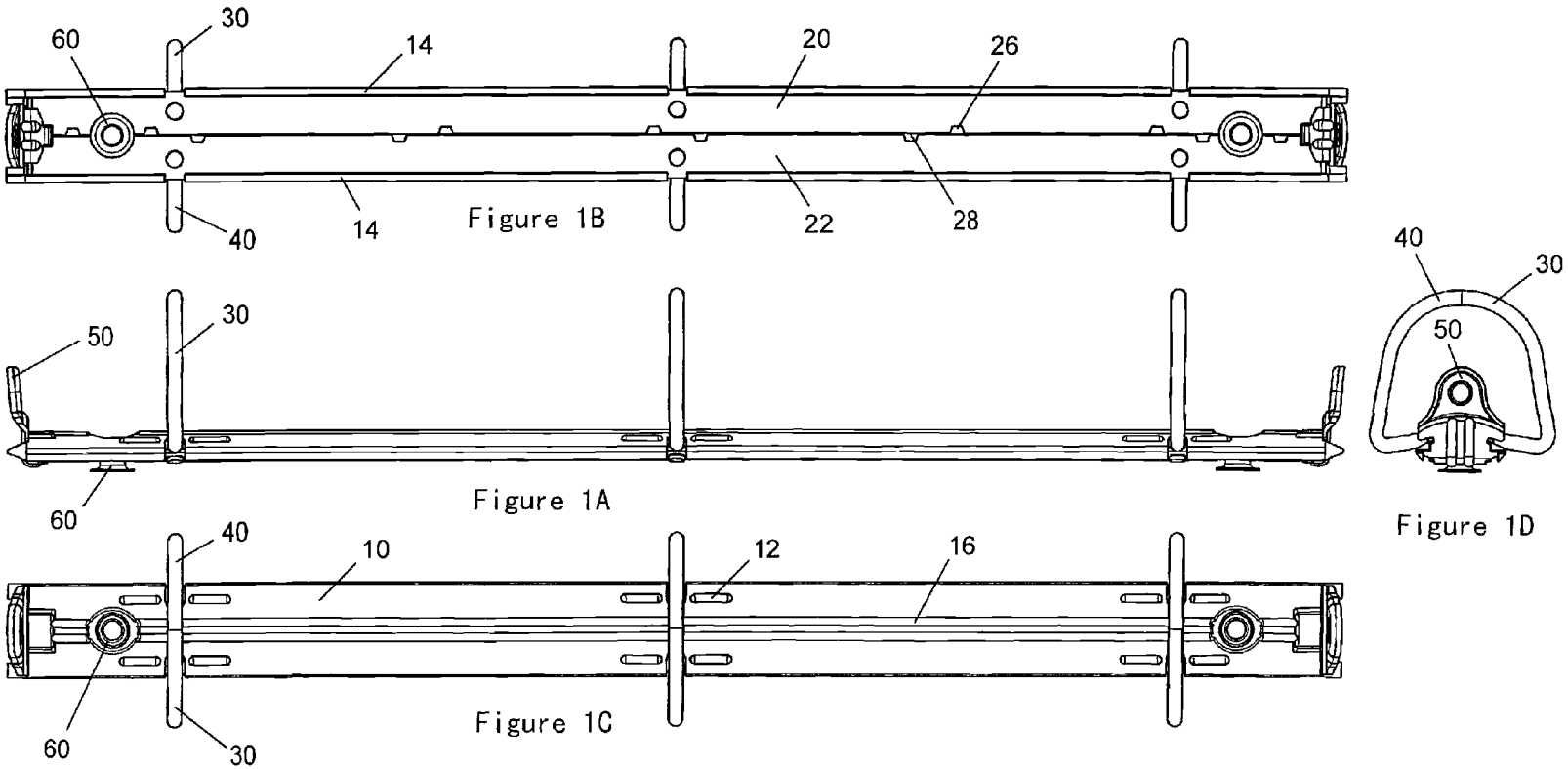
FIG. 1A is a front view of a ring binder according to a first embodiment of the present invention.
FIG. 1B is a bottom view of the ring binder according to the first embodiment of the present invention.
FIG. 1C is a top view of the ring binder according to the first embodiment of the present invention.
FIG. 1D is a left side view of the ring binder according to the first embodiment of the present invention.

Now the preferred embodiments of the present invention will be described with reference to the drawings. It is to be understood that all the embodiments are illustrated here for explaining the basic idea of the present invention which is not intended to be limited to the details of the embodiments.

Referring to FIGS. 1A-1D and 2-6, a ring binder according to a first embodiment of the present invention comprises a elongated housing 10 extending in a longitudinal direction, a pair of hinge plates 20, 22 located side by side in the housing and clamped together by the housing, one or more pairs of half ring members 30, 40 fixed to the pair of hinge plates respectively, actuating levers 50 provided at the opposite ends of the housing for actuating the hinge plates and the half ring members to move, and attaching members 60 provided near the opposite ends of the housing at positions longitudinally inward from the actuating levers 50 for attaching the ring binder to its carrier, such as a rigid panel or a cover of a file.

the housing 10 has a generally arcuate shape with an upward convex in its cross section perpendicular to the longitudinal direction, and includes bent-in edges 14 formed from the opposite side edges of the housing. The housing 10 is relatively highly rigid, but still has certain elasticity so that it can be slightly expanded in a transverse direction by the hinge plates 20, 22.

Three pairs of half ring members 30, 40 for inserting through the holes formed along an edge of a loose leaf page are fixed to the hinge plates 20, 22 respectively at corresponding longitudinal locations. The longitudinal distance between the pairs of half ring members are substantially the same. The half ring members of each pair cooperatively form a ring for retaining loose leaf pages, and are closed and opened with the pivoting of the hinge plates. In a closed position (FIGS. 1A-1D, 3 and 4) of the ring or of the half ring members, tip ends of opposite half ring members provided on the hinge plates at the same longitudinal locations abut against each other, so that a complete ring for retaining pages is formed by the two half ring members. In an open position (FIGS. 5 and 6) of the ring or of the half ring members, the tip ends of the opposite half ring members are separated from each other to form an opening therebetween through which loose-leaf pages can be taken out or loaded into the binder.

The hinge plates 20, 22 abut against each other at their inner edges and engage with the bent-in edges 14 of the housing at their outer edges. The hinge plates are hinged to each other so that they can pivot relative to each other within a certain angle. Stopping tabs 26, 28 formed respectively on the inner edges of the hinge plates 20, 22 protrude towards the inside of the housing. The stopping tabs on each of the hinge plates engage with the inner edge of the opposite hinge plate, so as to keep the inner edges of the two hinge plates together in a pivotable manner.

The hinge plates 20, 22 are pivotable between two extreme pivoting positions consisting of an expended extreme position in which the hinge plates are expended downwardly from the housing and which corresponds to the closed position of the half ring members when the tip ends of each pair of half ring members engage with each other, and a retracted extreme position in which the hinge plates are retracted upwardly into the housing and which corresponds to the open position of the half ring members when the inner edges of the hinge plates abut against the inner surface of a top wall of the housing. In an assembled state, when the hinge plates 20, 22 are in one of the extreme pivoting positions or in a non-stable intermediate position between the two extreme pivoting positions, a distance between the outer edges of the hinge plates 20, 22 in a transverse direction is slightly larger than the transverse distance between the outer edges of the housing in an unassembled state, i.e., without receiving the hinge plates in it. Thus, in the assembled state, the hinge plates 20, 22 slightly expand the outer edges of the housing outwardly in the transverse direction. Since the housing has a relatively high rigidity, the hinge plates always receive transversely inward biasing forces from the outer edges of the housing, no matter which position the hinge plates are in. The biasing forces push the hinge plates into one of the extreme pivoting positions and keep them in this position. Further, it is understood that, when the hinge plates are in a co-planar intermediate position, i.e., they form an angle of 180° with each other, the biasing forces reach to their maximal levels. Thus the intermediate position is a non-stable position, from which the hinge plates will pivot towards one of the extreme pivoting positions under the biasing forces, until they reach this position and keeps stable therein.

The opposite outer edges of the housing 10 are formed with cutouts 15 which extend in the transverse direction. The longitudinal locations and the number of the cutouts 15 correspond to that of the half ring members fixed to the hinge plates, so that the half ring members extend through the cutouts 15 to a level above the housing 10. Further, the cutouts 15 each have a certain length in the transverse direction, so as not to impede the pivoting movement of the half ring members.

Figure 2:
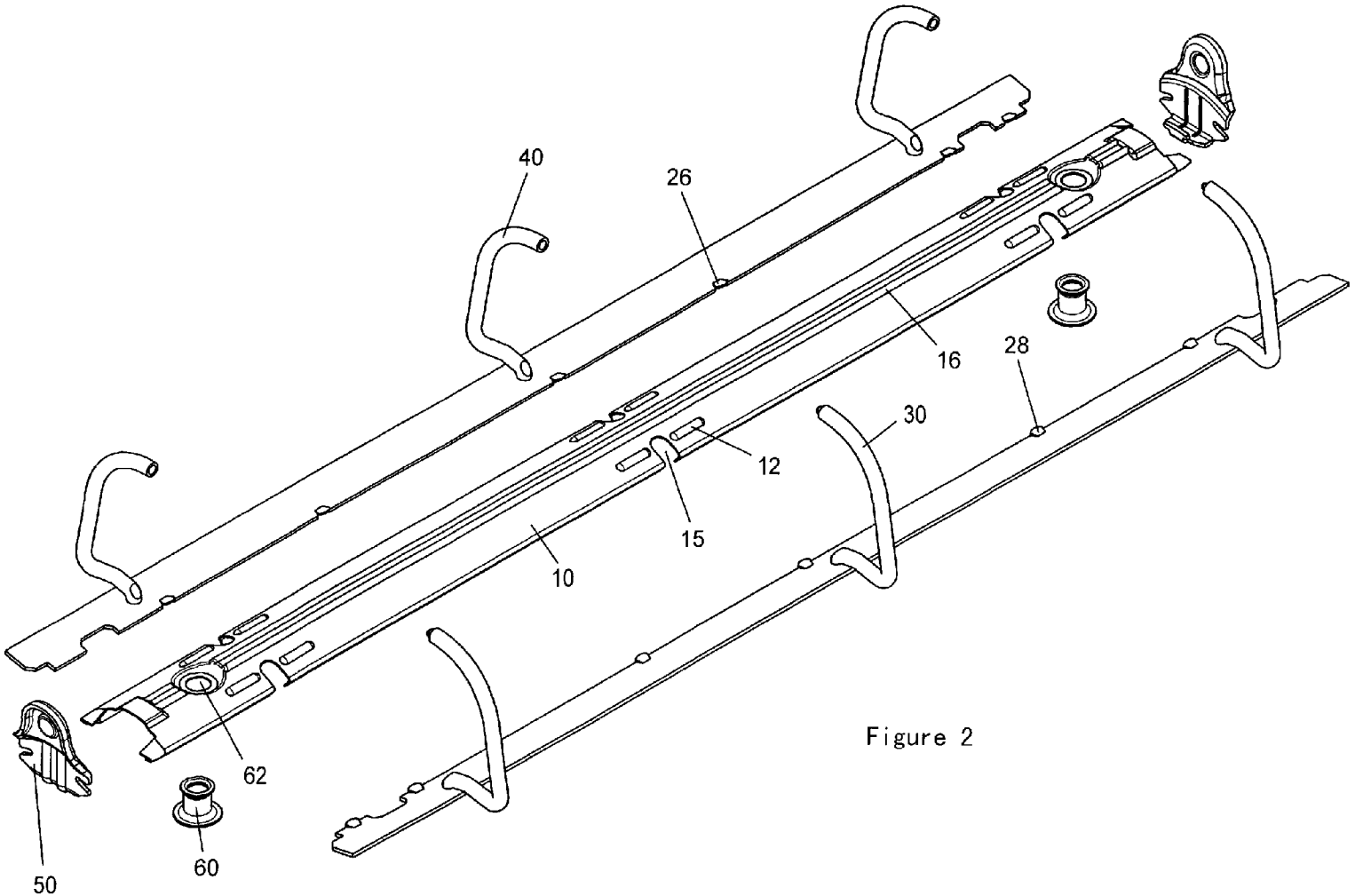
FIG. 2 is an exploded perspective view of the ring binder according to the first embodiment of the present invention.
Figure 3:
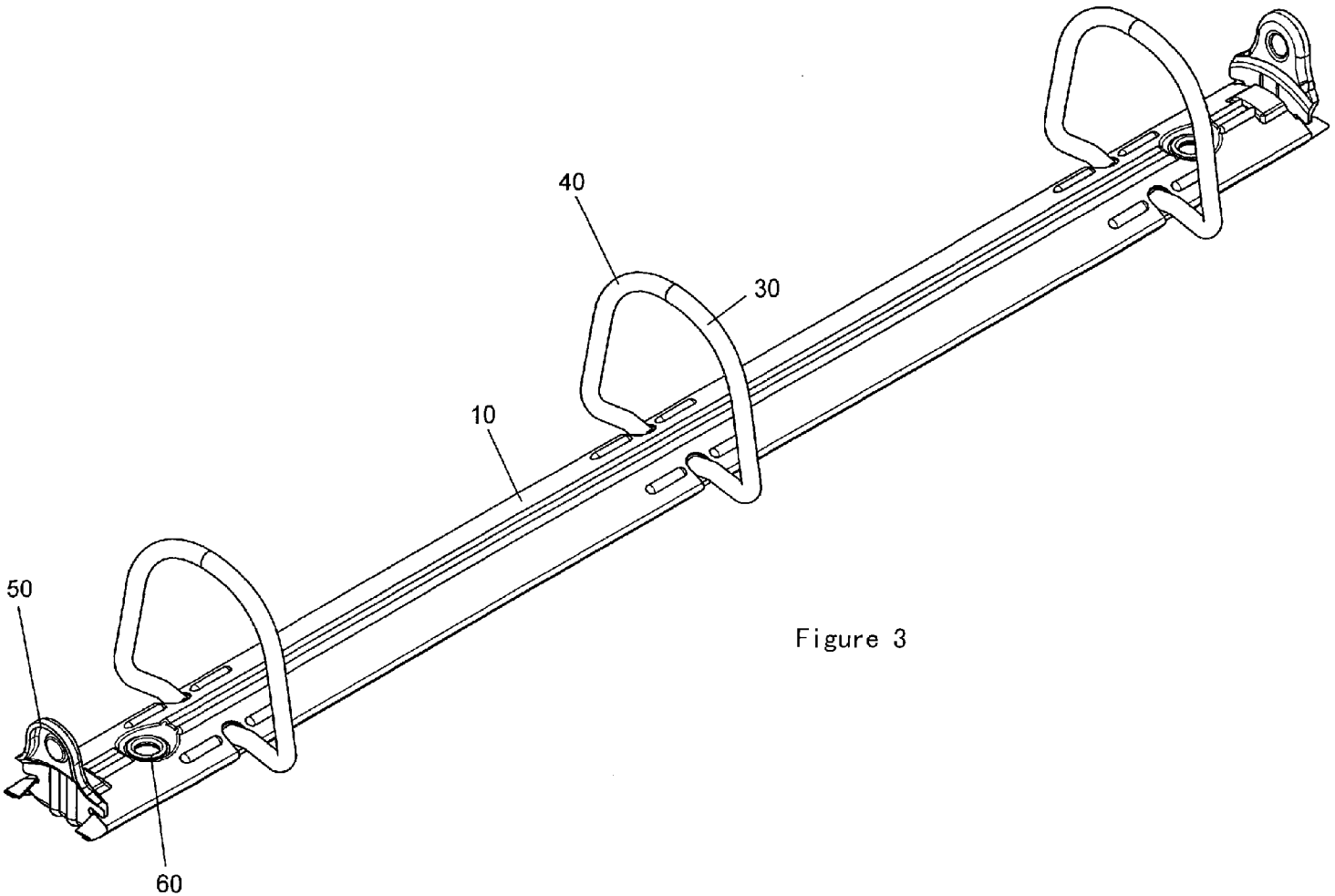
FIG. 3 is a top perspective view of the ring binder according to the first embodiment of the present invention in an assembled state, wherein half ring members are shown in a closed position.
Figure 4:
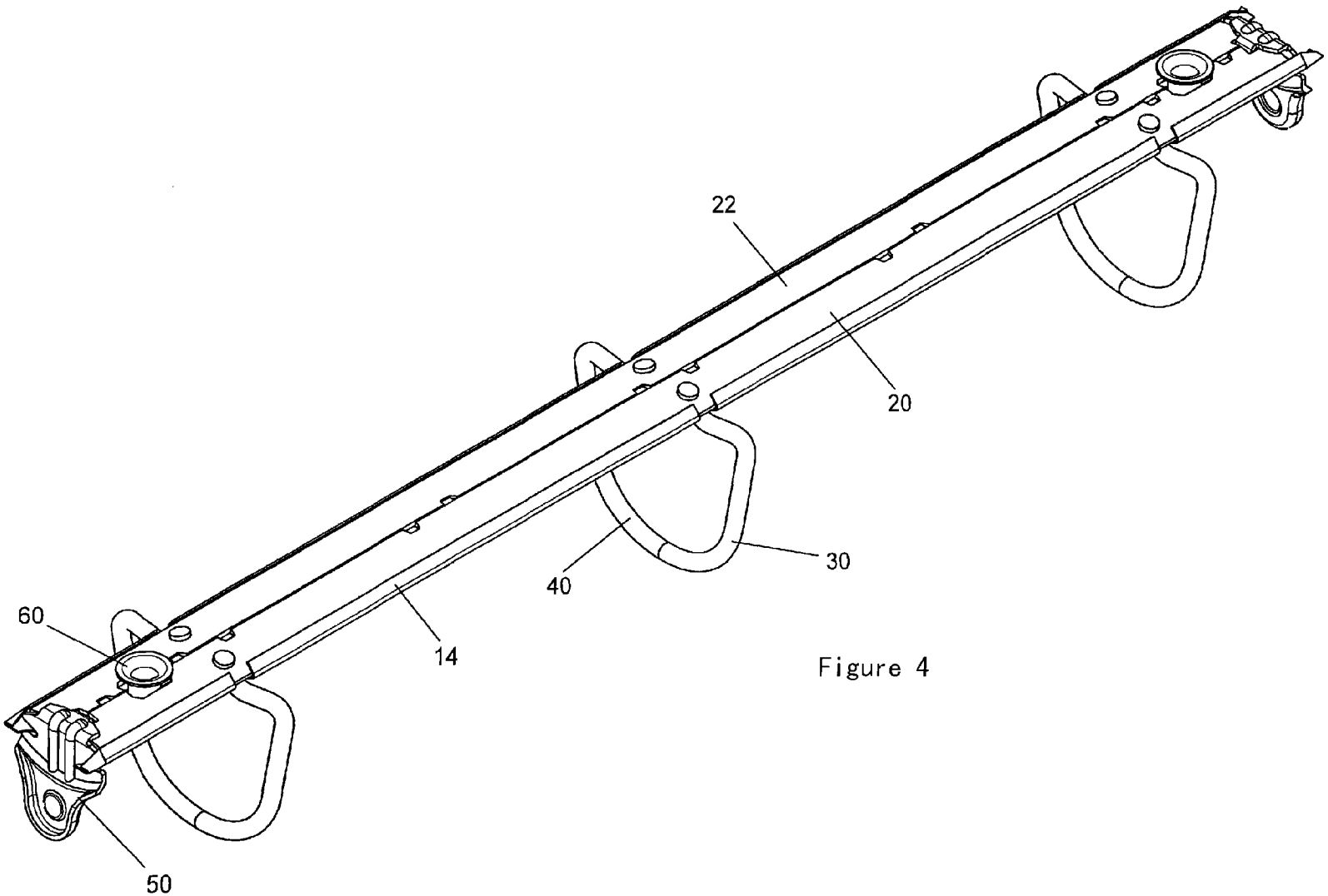
FIG. 4 is a bottom perspective view of the ring binder according to the first embodiment of the present invention in an assembled state, wherein half ring members are shown in a closed position.
Figure 5:
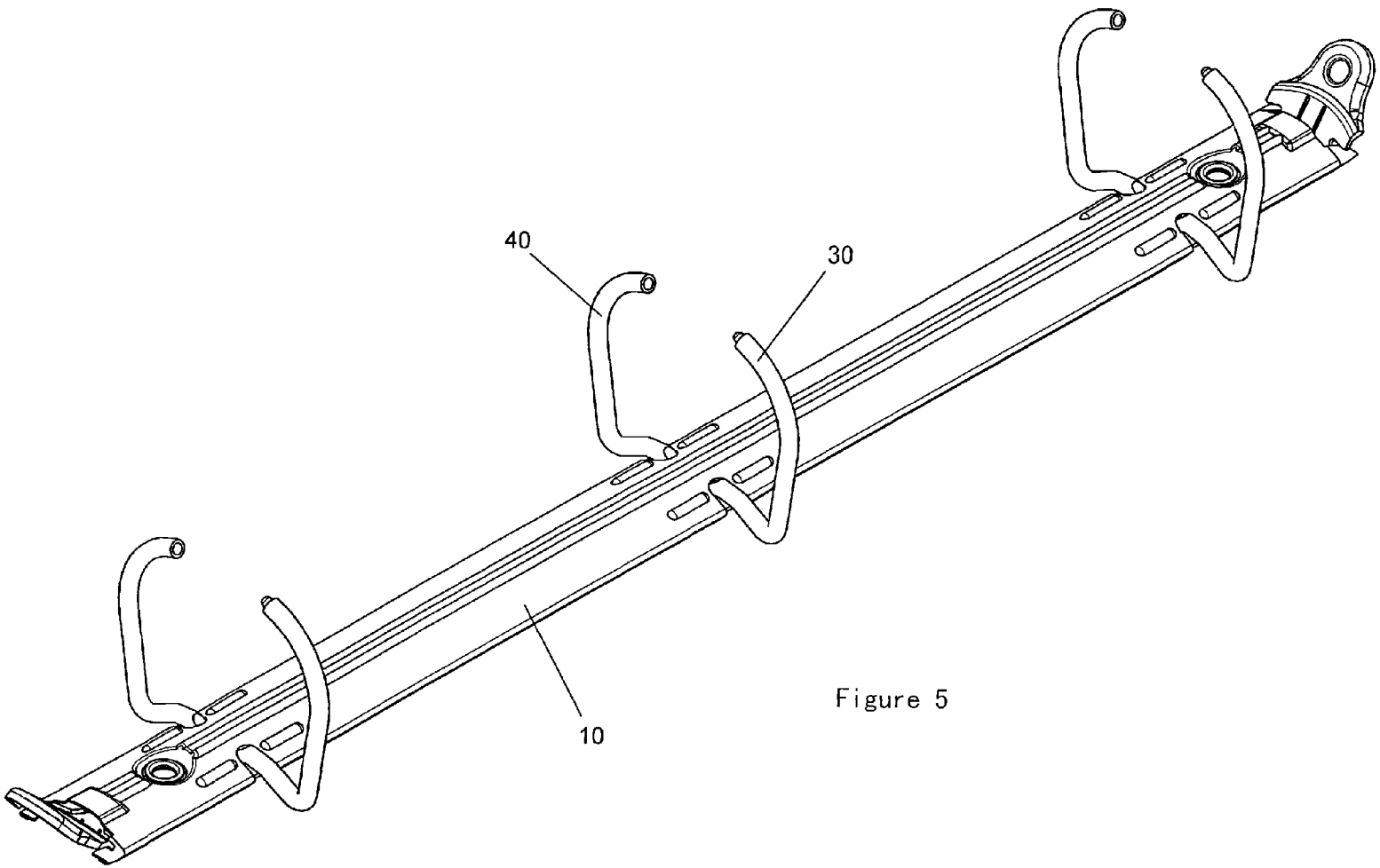
FIG. 5 is a top perspective view of the ring binder according to the first embodiment of the present invention in an assembled state, wherein half ring members are shown in an open position.
Figure 6:
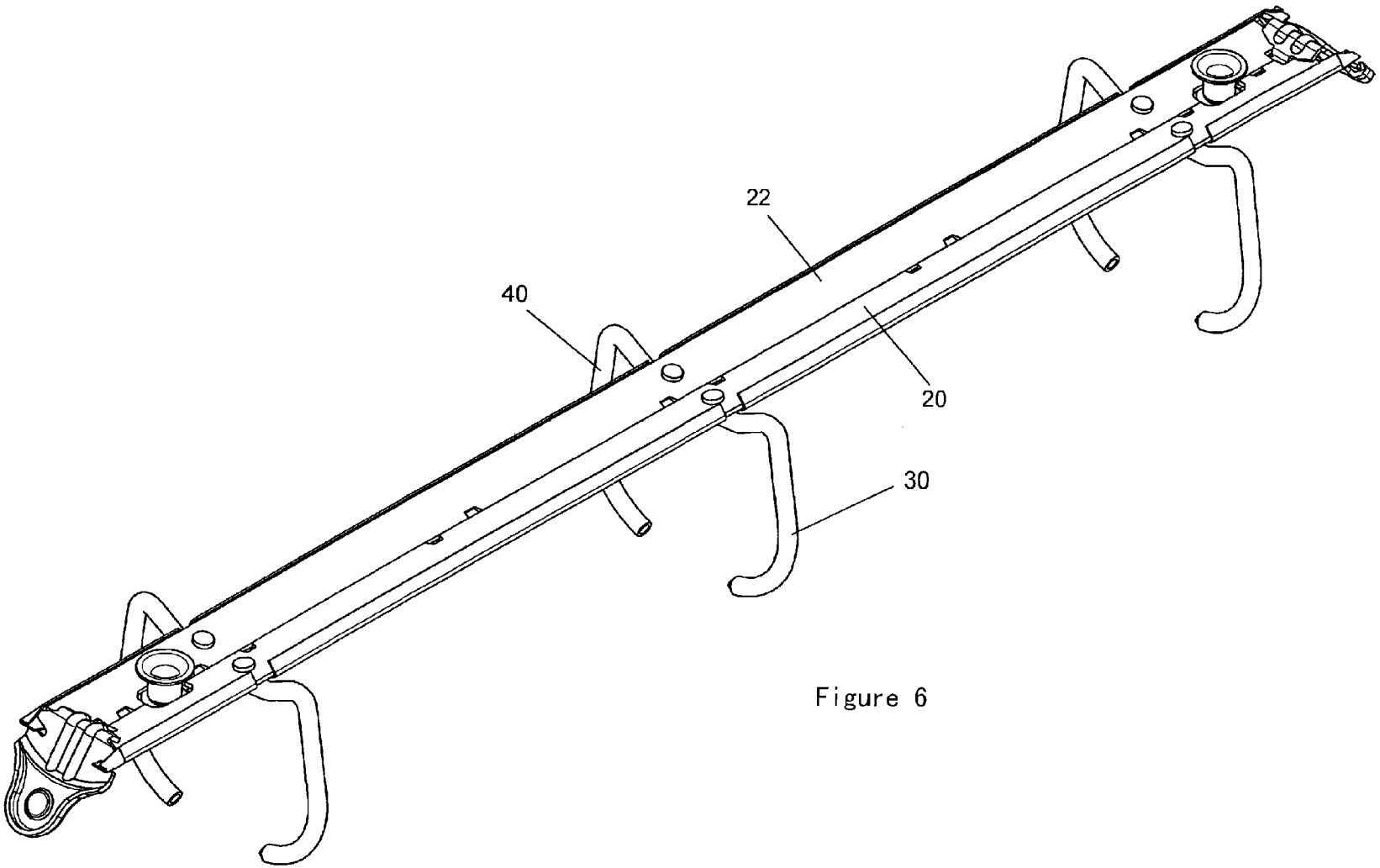
FIG. 6 is a bottom perspective view of the ring binder according to the first embodiment of the present invention in an assembled state, wherein half ring members are shown in an open position.

In the first embodiment of the present invention, the cutouts 15 are transversely opened through the bent-in edges 14, as shown in FIGS. 2, 4 and 6 in details. Such a design has an advantage of easy assembling. That is to say, it is easy for the half ring members extending through the cutouts for assembling the housing and the hinge plates together. However, this design unavoidably reduces the strength of the bent-in edges 14 as well as that of the whole housing 10. As an option, the cutouts may be not opened through the bent-in edges 14, or in other words, they only extend through a portion of the bent-in edges 14. In this way, although the assembling process become somewhat complex, the strength of the bent-in edges 14 as well as that of the whole housing 10 will be increased.

The housing 10 and the hinge plates 20, 22 are each formed by a sheet metal, such as sheet steel. The half ring members 30, 40 are formed by thin metal bars.

In order to improve the rigidity and the strength of the housing, the top wall of the housing is formed by pressing with reinforcement ridges 16 which extend in the longitudinal direction of the housing.

It can be seen that the half ring members extend from the hinge plates through the transverse cutouts to a level above the housing. In order to improve the rigidity and the strength of the housing near the transverse cutouts, reinforcement ribs 12, which extend in the longitudinal direction, are formed by pressing on the housing near the transverse cutouts.

Furthermore, the rigidity of the hinge plates should be higher than that of the housing. To this end, the thickness of the hinge plates is larger than that of the housing. Alternatively, the hardness and the rigidity of the material of the hinge plates are higher than that of the housing. Preferably, each of the hinge plates 20, 22 is formed by pressing with reinforcement ribs (not shown) which extend in the longitudinal direction and may be separated with each other in the longitudinal direction.

The actuating levers 50 each comprise a driving portion which engages with inner portions of longitudinal ends of the pair of hinge plates. When the ring (or the half ring members) is in the closed position, a user may press the actuating levers 50 outwardly in the longitudinal direction, so that the driving portions push the transversely inner portions of longitudinal ends of the hinge plates upwardly, forcing the pair of hinge plates to pivot upwardly to the retracted extreme position. On the other hand, when the ring (or the half ring members) is in the open position, the user may press the actuating levers 50 inwardly in the longitudinal direction, so that the driving portions push the transversely inner portions of longitudinal ends of the hinge plates downwardly, forcing the pair of hinge plates to pivot downwardly to the expended extreme position.

Alternatively, without using the actuating levers 50, the user may simultaneously pull one or more pairs of half ring members inwardly or outwardly to close or open the rings. In this condition, when closing the rings, the user should avoid his or her fingers to be snapped by the half ring members.

The attaching members 60 extend through attaching holes 62 formed at the opposite ends of the housing, so that the housing (and the whole ring binder) can be attached to a carrier for the ring binder.

Now the rings (the half ring members) will be explained in details.

As shown in FIGS. 7A-7D and other related figures, each of the rings comprises two half ring members 30, 40. The plane in which the ring lies is a transverse plane perpendicular to the longitudinal axis of the housing. Each of the half ring members 30, 40 is formed as a single piece, and has an anchoring portion 32, 42 at its lower end for anchoring to a corresponding hinge plate. For correctly locating the half ring member to the hinge plate, at least one side surface of the anchoring portion is formed with (for example, by pressing or cutting) a locating portion X. The hinge plate is formed with an inserting hole having a fitting portion to be engaged with the locating portion of the anchoring portion. The anchoring portion is inserted into the inserting hole from above, so that the bottom end of the anchoring portion is exposed from the lower surface of the hinge plate. Then, the exposed bottom end of the anchoring portion is forged to become thicker, so that the anchoring portion is completely anchored to the hinge plate. Thus, the half ring member is fixed and positioned the hinge plate.

In the example shown in FIGS. 7A-7D, each anchoring portion 32, 42 is formed with opposite locating portions X in the form of locating planes which are parallel to the longitudinal direction of the housing. However, it is understood that the locating planes may have other orientations, such as perpendicular to the longitudinal direction of the housing. Furthermore, there may be any number of locating portions, and the locating portions may also have various shapes other than planar surfaces. In summary, any type of locating portions can be used if the anchoring portion can fit with the corresponding inserting hole of the hinge plate to correctly position the half ring member with respect to the hinge plate.

Figure 7C:
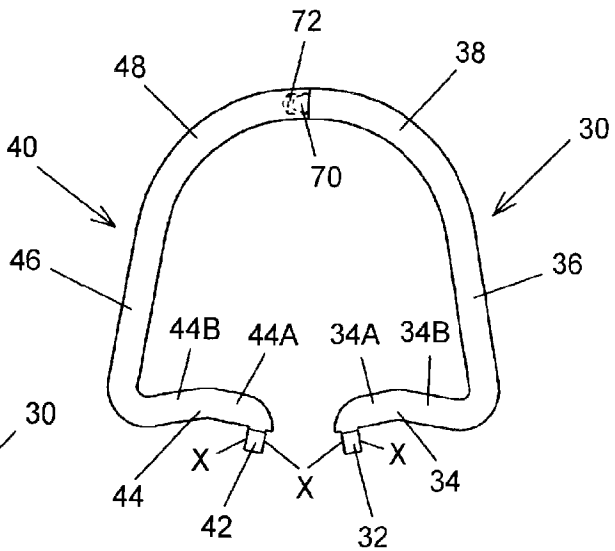
FIGS. 7C and 7D is a front view of the ring of the present invention in an assembled state.
Figure 7D:
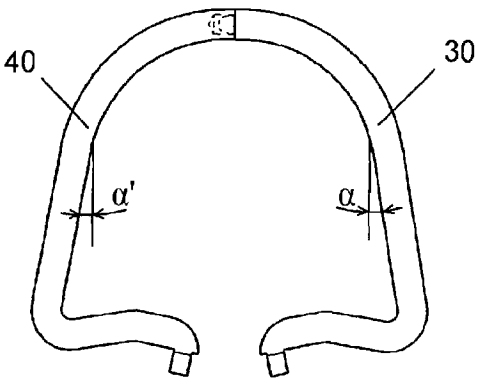
Figure 7B:
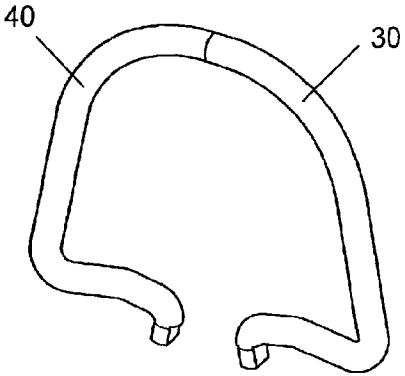
FIG. 7B is a perspective view of the ring of the present invention in an assembled state.
Figure 7A:
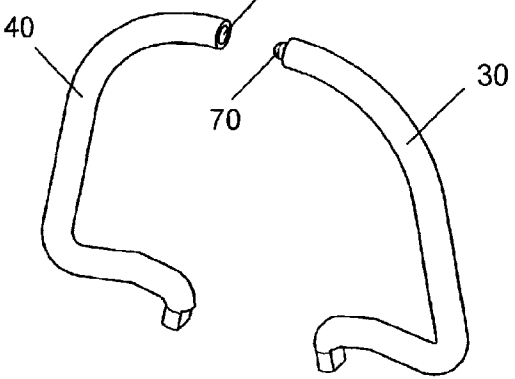
FIG. 7A is an exploded perspective view of a ring of the present invention.
Figures 8A, 8B, 8C, 8D:
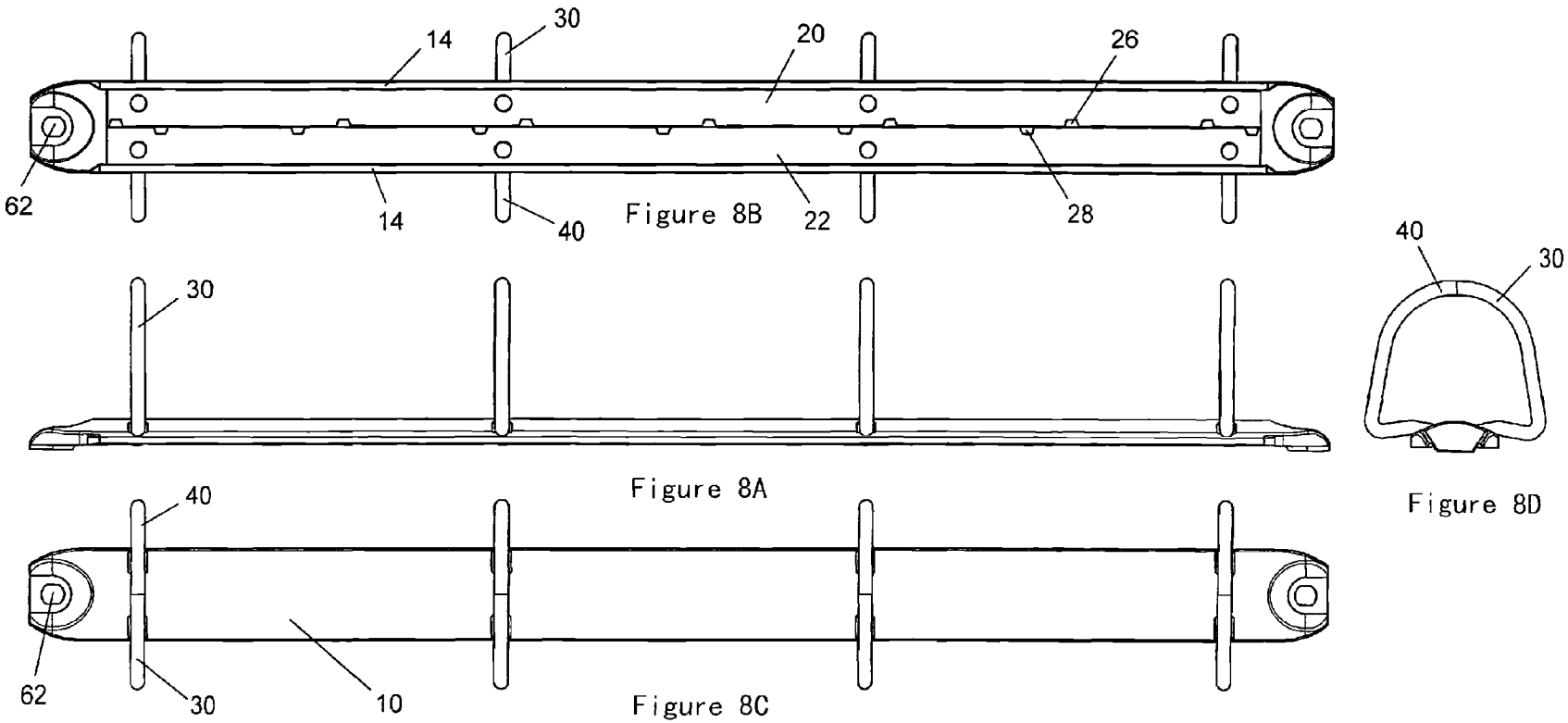
FIG. 8A is a front view of a ring binder according to a second embodiment of the present invention.
FIG. 8B is a bottom view of the ring binder according to the second embodiment of the present invention.
FIG. 8C is a top view of the ring binder according to the second embodiment of the present invention.
FIG. 8D is a left side view of the ring binder according to the second embodiment of the present invention.
Figure 9:
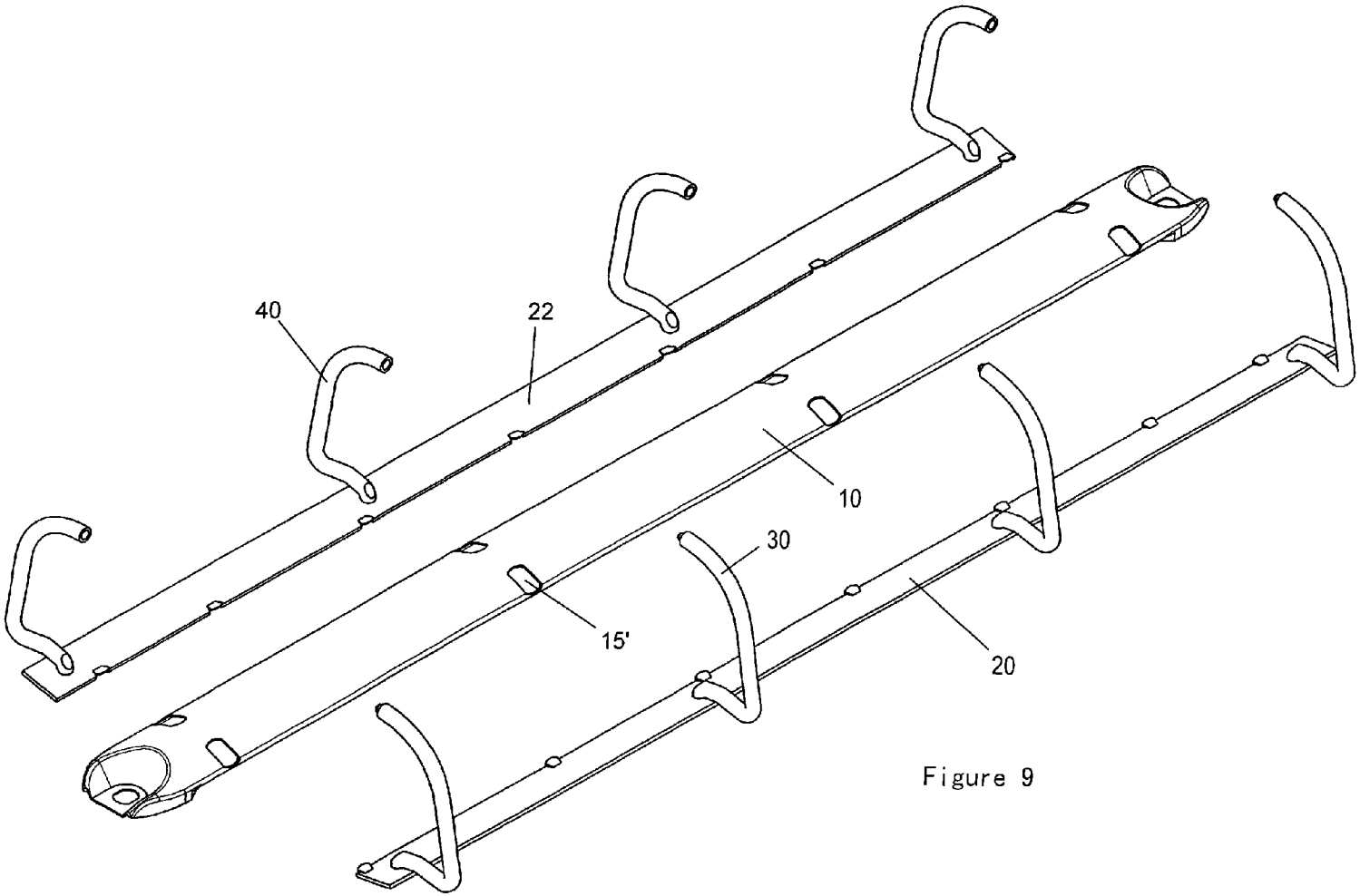
FIG. 9 is an exploded perspective view of the ring binder according to the second embodiment of the present invention.
Figure 10:
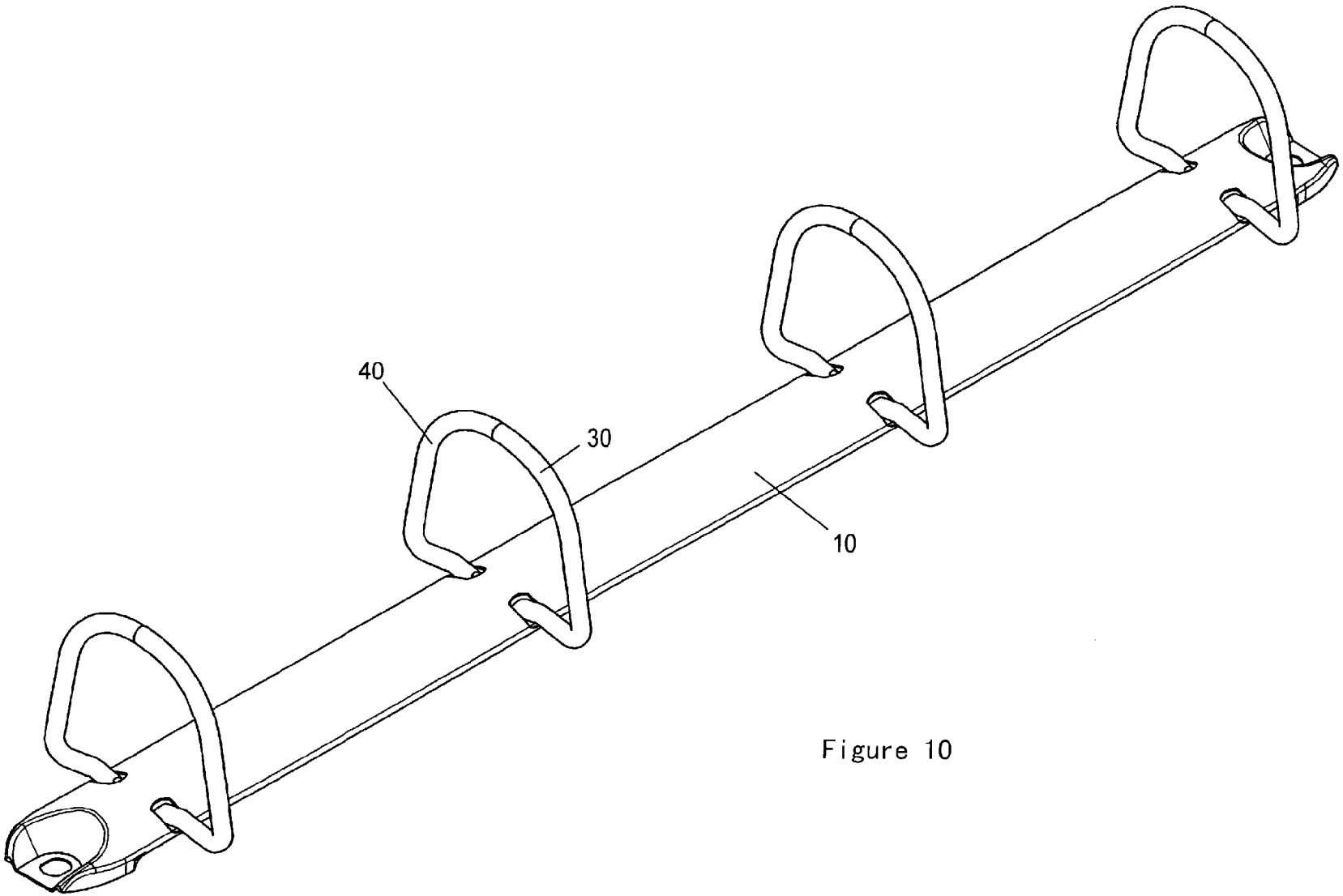
FIG. 10 is a top perspective view of the ring binder according to the second embodiment of the present invention in an assembled state, wherein half ring members are shown in a closed position.
Figure 11:
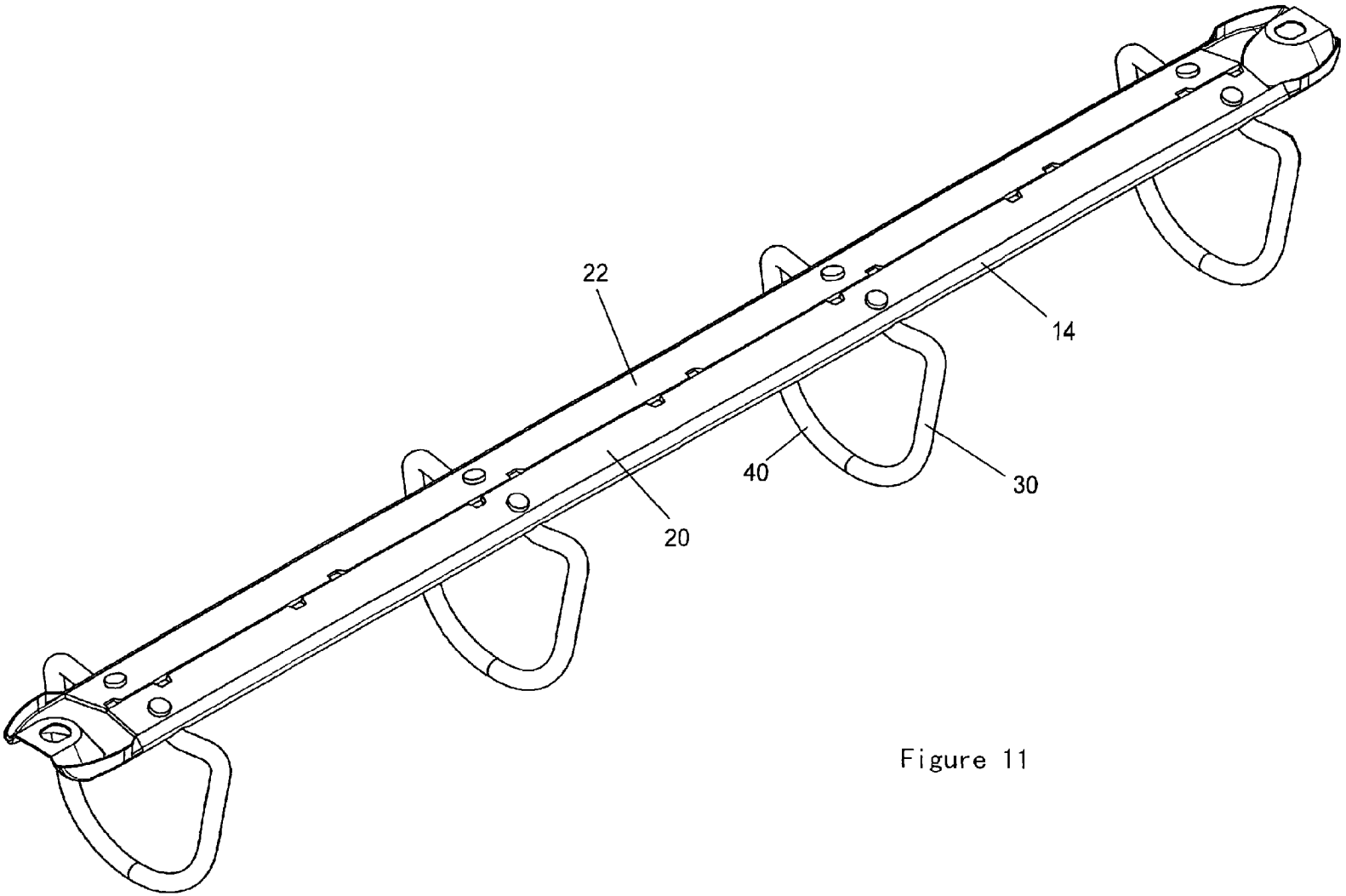
FIG. 11 is a bottom perspective view of the ring binder according to the second embodiment of the present invention in an assembled state, wherein half ring members are shown in a closed position.
Figure 12:
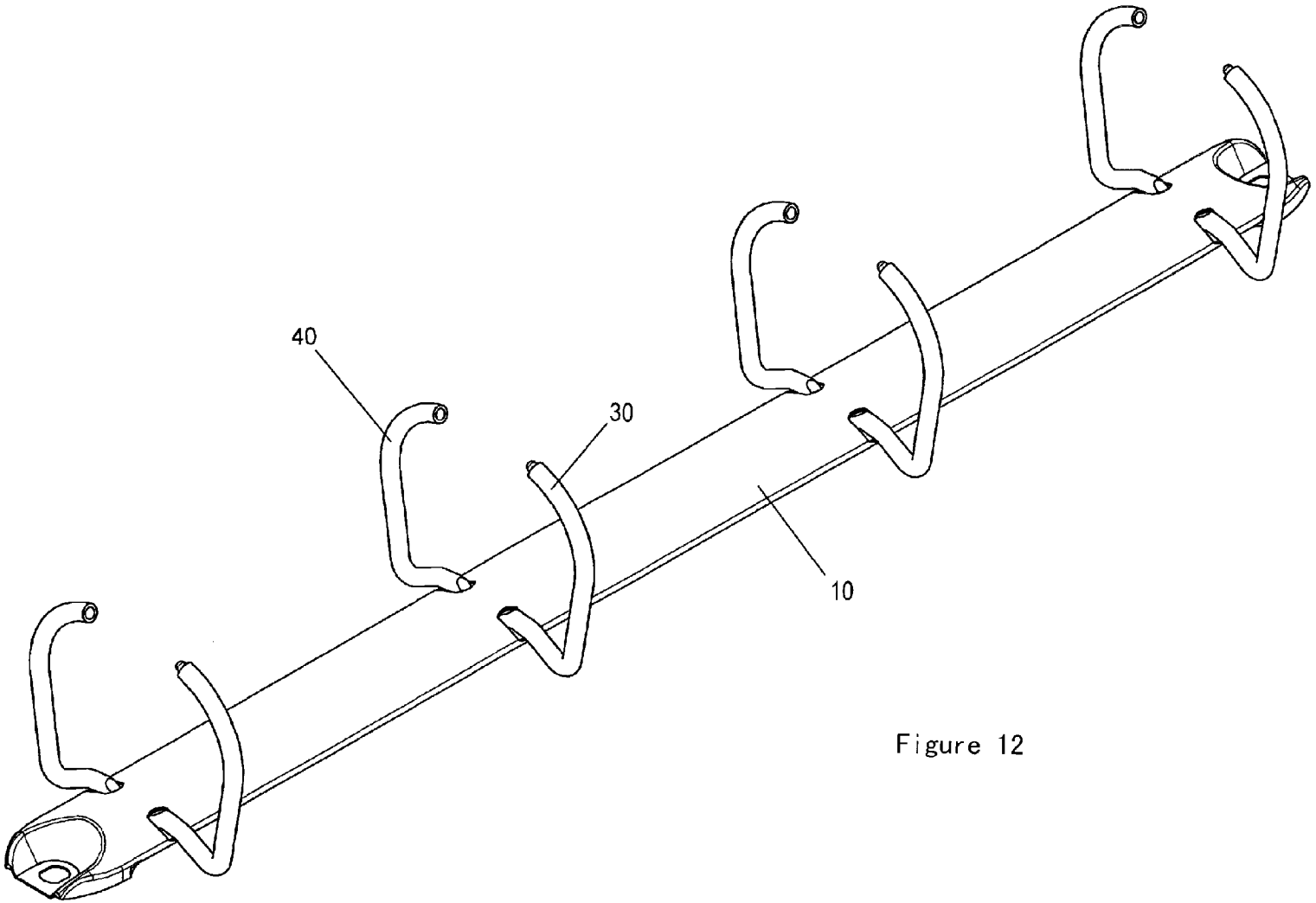
FIG. 12 is a top perspective view of the ring binder according to the second embodiment of the present invention in an assembled state, wherein half ring members are shown in an open position.
Figure 13:
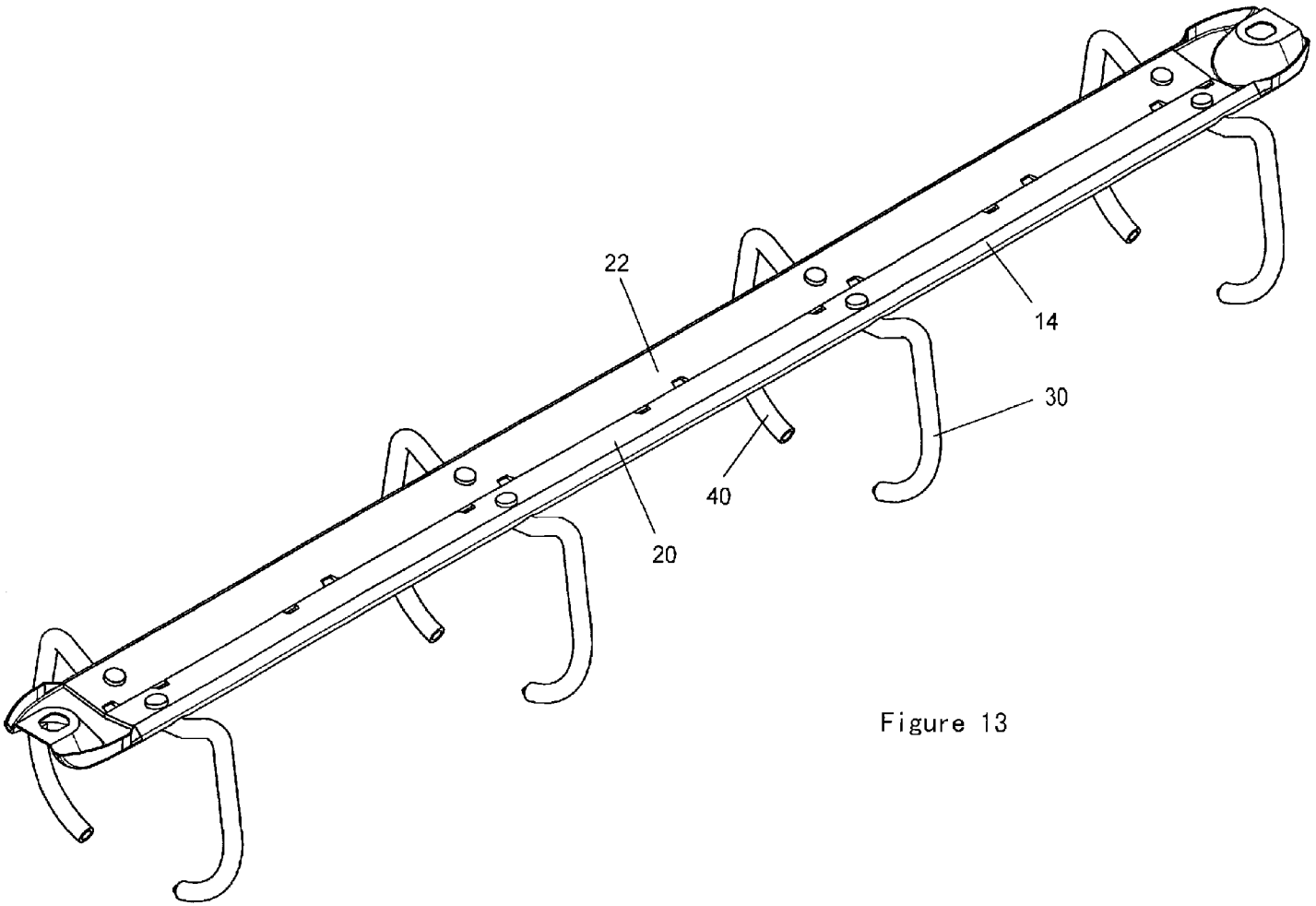
FIG. 13 is a bottom perspective view of the ring binder according to the second embodiment of the present invention in an assembled state, wherein half ring members are shown in an open position.

The closed position of the half ring members is shown in FIGS. 7C and 7D. It is understood that, in this state, the hinge plates are in the downwardly expended extreme position, and thus the anchoring portions which are generally perpendicular to corresponding hinge plates are inclined now. Specifically, the anchoring portion is outwardly inclined from its top end to its bottom end with respect to the vertical central axis of the ring.

Then, each of the half ring members 30, 40 has a transverse arm portion 34, 44 extended outwardly from the anchoring portion in the transverse direction, with the inner or lower and of the transverse arm portion integrally connected to the top end of the anchoring portion. Each transverse arm portion may be formed in a straight manner, i.e., the transverse arm portion 34, 44 as a whole extends along a straight line generally perpendicular to the anchoring portion and is orientated in a generally horizontal position when the half ring members are in the closed position. Alternatively, each transverse arm portion may comprise two sections. Specifically, as most clearly shown in FIG. 7C, each transverse arm portion 34, 44 comprises two sections, i.e., an inner transverse arm section 34A, 44A and an outer transverse arm section 34B, 44B, which are formed integrally with each other. The inner transverse arm section is formed in a straight manner, extended from anchoring portion outwardly, preferably generally perpendicular to the anchoring portion and is orientated in a generally horizontal position when the half ring member is in the closed position. The outer transverse arm section is contiguous to the outer end of the inner transverse arm section, and is inclined outwardly and downwardly with respect to the inner transverse arm section. By forming the outwardly and downwardly inclined outer transverse arm section, the height of the outer end of the transverse arm portion 34, 44 is reduced, especially when the half ring member is opened, so that the pages retained by the ring binder lie close to the carrier on which the binder is attached.

Then, each of the half ring members 30, 40 has an oblique arm portion 36, 46 integrally extending upwardly and inwardly from the outer end of the corresponding transverse arm portion along a generally straight line. The lower end of the oblique arm portion is contiguous to the outer end of the transverse arm portion. An acute angle is formed between the transverse arm portion 34, 44 and the connected oblique arm portion 36, 46. In the closed position of the rings (or of the half ring members), each oblique arm portion 36, 46 is inclined inwardly with an angle $\alpha$, $\alpha'$ formed between the oblique arm portion and the vertical direction, as can be seen from FIG. 7D. When the rings (or the half ring members) are pivoted from the closed position to the open position, each of the half ring members (or its oblique arm portion) pivots outwardly through a pivot angle which is larger than angle $\alpha$ or $\alpha'$, so that each oblique arm portion 36, 46 reaches to an orientation that is outwardly inclined with respect to vertical direction by an angle which equals to the pivot angle subtracts angle $\alpha$ or $\alpha'$.

Preferably, the half ring members 30 and 40 are symmetrical to each other, in which condition angle $\alpha$ equals to angle $\alpha'$. Still preferably, angle $\alpha$ or $\alpha'$ equals to one half of the pivot angle of the oblique arm portion 36 or 46. In this case, the inward inclination of the oblique arm portion in the closed position and the outward inclination of the oblique arm portion in the open position equal to each other and both equal to one half of the pivot angle of the half ring member (or of the oblique arm portion).

The angle $\alpha$, $\alpha'$ may be in the range of 5°~45°, preferably in the range of 10°~30°, and most preferably in the range of 15°~25°, the pivot angle of the half ring member (or of the oblique arm portion) may be in the range of 15°~90°, preferably in the range of 20°~60°, and most preferably in the range of 25°~40°.

By means of this, when the ring (or the half ring member) is in either of the closed position and the open position, the oblique arm portion is inclined. Since the oblique arm portion is inclined inwardly in the closed position and is inclined outwardly in the open position, that is to say, the pivot angle of the half ring member (or of the oblique arm portion) is divided into an inward inclination and an outward inclination of the oblique arm portion, the inclination of the oblique arm portion is not too large, no matter which one of the closed position and the open position is occupied by the ring. In addition, since the oblique arm portion is straight, the pages retained by the oblique arm portion are stacked one above another with the edges of the pages keeping aligned tidily. In other words, the left and right edges of a stack of pages are aligned in a slight outward or inward inclination following the inclination of the oblique arm portion. Since the inclination of the oblique arm portion is not too large in the closed position and the open position, for example, both equal to one half of the pivot angle of the half ring member (or of the oblique arm portion), the arrangement and the appearance of the stack of pages will not be significantly affected by the oblique arm portion when moved from the closed position to the open position. In this case, the stack of pages is changed from a slightly inward inclined posture to a slightly outward inclined posture, but the tidiness of the edges of the pages will not be changed significantly.

Then, each of the half ring members 30, 40 has a curved portion 38, 48 extended upwardly and inwardly from the upper end of the oblique arm portion 36, 46. The lower end of the curved portion is contiguous to the upper end of the oblique arm portion 36, 46. Each curved portion may be an arc section, such as a circular section or an elliptic section. The radian of the arc section or the angle extended through by the arc section is selected so that there is a smooth and continuous transition between the curved portion and the oblique arm portion. By way of example, the radian may be in the range of 30°~90° for an elliptic section or in the range of 45°~85° for a circular section. When the half ring members is in the closed position, the upper end of the two curved portion 38, 48 abut against to each other in a face to face manner, and thus the two curved portion 38, 48 form an upwardly directed arc, such as an circular arc or an elliptic arc, including a semi-circle or a semi-ellipse.

Since the upper portion of the half ring forms a curved portion, there is a smooth and continuous transition between the upper portion and the side portion (oblique arm portion) of the half ring member, without forming any significant bent. Thus, the punched holes in the pages are easy to be inserted through by the half ring member. In other words, it is easy to load the pages to the binder. Furthermore, the pages retained by the binder are easy to be turned from one of the half ring members to the other of the half ring members.

For facilitating the alignment between the tip ends of a pair of half ring members, or the upper ends of the curved portions, and keeping such alignment to prevent the two half ring members from misaligned from each other during the operation and using of the binder, engaging structures are formed at the upper ends of the curved portions. The engaging structures may be serrated profiles, stepped profiles or the like. In the example shown in FIGS. 7A-7D, the engaging structures comprise a projection 70 formed on the tip end surface of one of the half ring members and a recess 72 formed in the tip end surface of the other of the half ring members for receiving the projection 70 therein. Although the projection 70 is shown on the half ring member 30 and the recess 72 is shown in the half ring member 40, it is obvious that their locations can be exchanged. The size of the recess 72 is slightly larger than that of the projection 70. Furthermore, for facilitating the insertion of the projection 70 into the recess 72, the projection 70 may have a cross section gradually enlarged from its front end to its rear end, and/or the recess 72 may have a cross section gradually reduced from its front end to its rear end. By way of example, the recess 72 is formed with a shape of a prism, a cylinder, a circular cone or a prismatic cone (including truncated ones) gradually reduced from its front end to its rear end, and the like, while the projection 70 is formed with a shape of a prism or a cylinder with a chamfered or rounded front end, a circular cone or a prismatic cone (including truncated ones) gradually enlarged from its front end to its rear end, a semisphere or a part of a sphere, a semi-spheroid or a part of a spheroid, and the like.

It can be seen that a smooth transition is formed between the curved portion and the oblique arm portion of the half ring member, an acute angle is formed between the oblique arm portion and the transverse arm portion, and a right angle or an acute angle is formed between the transverse arm portion and the anchoring portion.

Now the ring binder according to a second embodiment of the present invention will be described with reference to FIGS. 8A-8D and 9-13. In the second embodiment, the parts or members which are the same in the first embodiment are represented by the same reference numerals, and detailed description to them is omitted.

In the second embodiment, rings (half ring members) having the same structure as that of the first embodiment are provided.

However, in the second embodiment, the ring binder comprises four pairs of half ring members 30, 40. Furthermore, the ring binder does not comprise any actuating lever, which means that the user should directly pull or push the half ring members to open or close them.

Furthermore, in the second embodiment, no reinforcement rib or ridge is formed on the housing 10 or the hinge plates 20, 22. Such a design is suitable for a condition that the inward biasing forces applied by the outer edges of the housing to the hinge plates in the transverse direction are not too high.

Furthermore, in the second embodiment, cutouts 15' formed at the outer edges of the housing 10 do not extend to the bent-in edges 14 in the transverse direction.

Obviously, the level of the inward biasing forces is partly depended on the difference of the distance between the outer edges of the two hinge plates and the distance between the outer edges of the housing when the hinge plates are not assembled in it. If the distance difference is large, the inward biasing forces are large, and the ability to maintain the rings closed or open is high, and vice versa.

Thus, when the inward biasing forces are not too large, it is easy to open and close the half ring members by manipulating the rings, and the housing and the hinge plates do not need to have high rigidity or strength. In this condition, however, the rings sometimes may be opened or closed unintentionally.

Other aspects of the second embodiment are the same as or similar to that of the first embodiment.

Figures 14A, 14B, 14C, 14D:
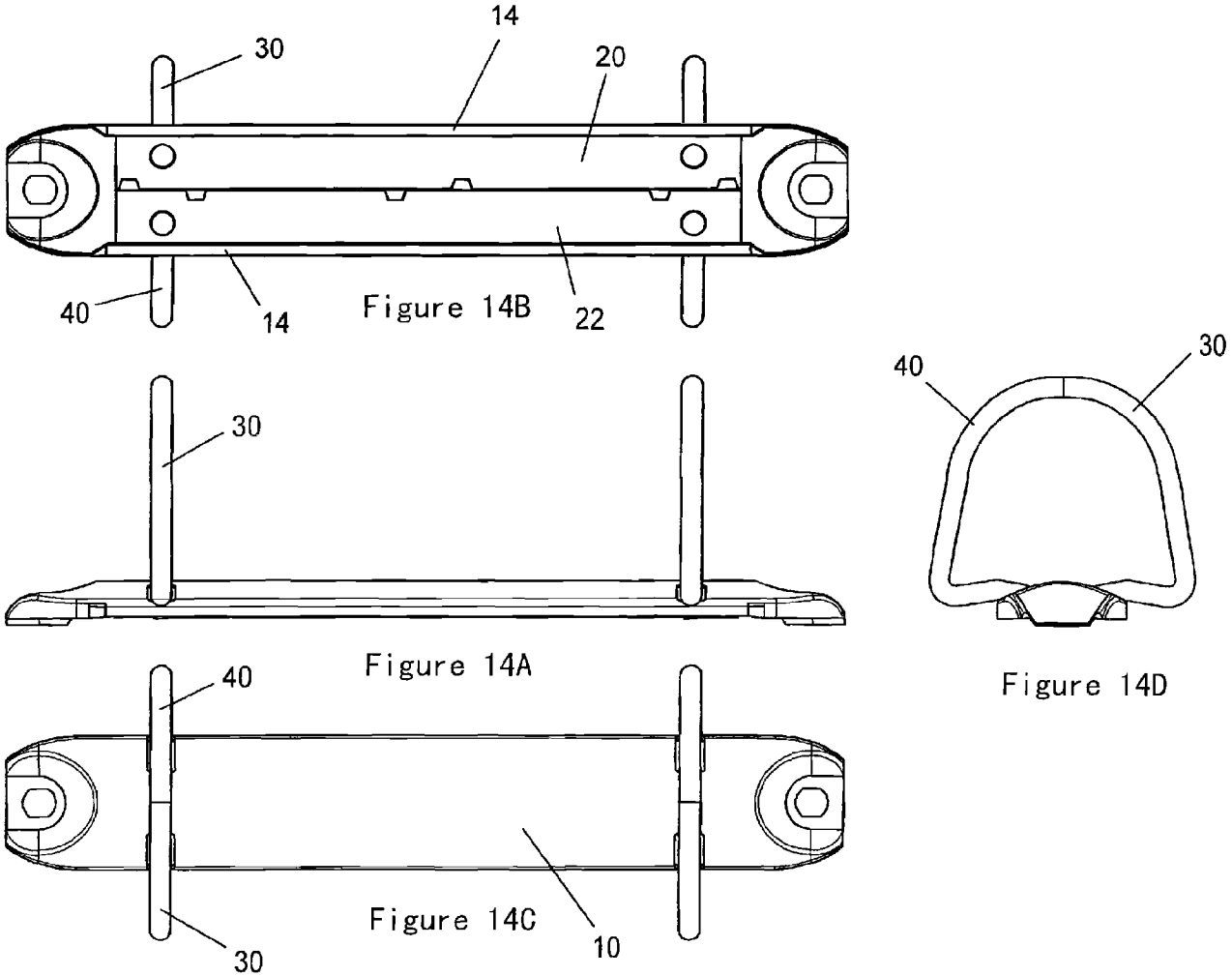
FIG. 14A is a front view of a ring binder according to a third embodiment of the present invention.
FIG. 14B is a bottom view of the ring binder according to the third embodiment of the present invention.
FIG. 14C is a top view of the ring binder according to the third embodiment of the present invention.
FIG. 14D is a left side view of the ring binder according to the third embodiment of the present invention.
Figure 15:
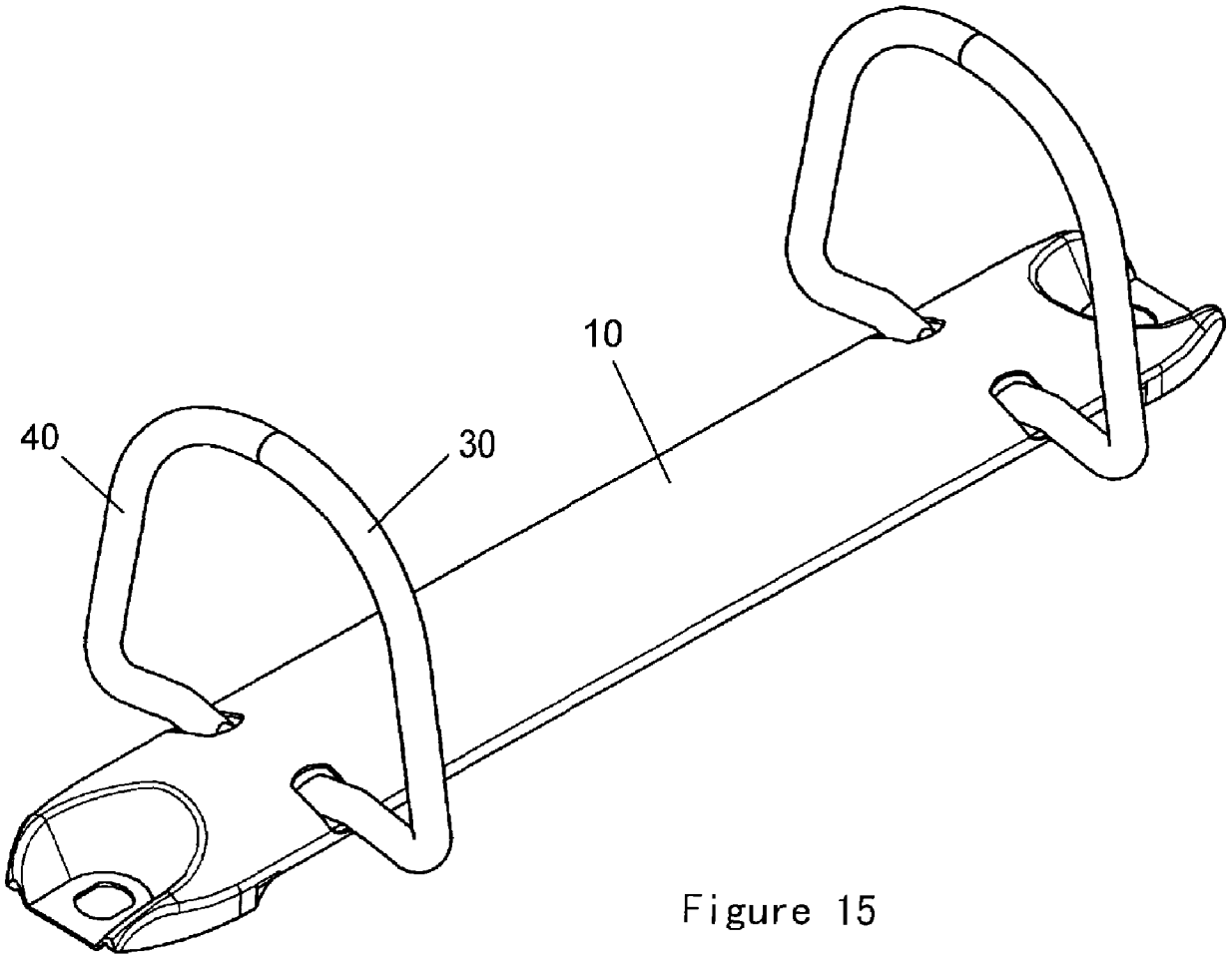
FIG. 15 is a top perspective view of the ring binder according to the third embodiment of the present invention in an assembled state, wherein half ring members are shown in a closed position.

Now the ring binder according to a third embodiment of the present invention will be described with reference to FIGS. 14A-4D and 15. In the third embodiment, the parts or members which are the same in the first and second embodiments are represented by the same reference numerals, and detailed description to them is omitted.

In the third embodiment, rings (half ring members) having the same structure as that of the first embodiment are provided.

However, in the third embodiment, the ring binder comprises two pairs of half ring members 30, 40.

As with the second embodiment, the ring binder of the third embodiment does not comprise any actuating lever, which means that the user should directly pull or push the half ring members to open or close them. Furthermore, in the third embodiment, no reinforcement rib or ridge is formed on the housing 10 or the hinge plates 20, 22. Such a design is suitable for a condition that the inward biasing forces applied by the outer edges of the housing to the hinge plates in the transverse direction are not too high.

Other aspects of the third embodiment are the same as or similar to that of the first and second embodiments.

According to the ring binder of the invention, the oblique arm portions of the two half ring members are obliquely orientated (being inwardly inclined in the closed position and outwardly inclined in the open position), thus the edges of a stack of pages retained by the half ring members are aligned tidily. Moreover, the upper portion of each half ring member is formed as a curved portion, with opposite curved portions forming an arc, thus the pages are easy to be loaded and turned from one of the half ring members to the other of the half ring members, without any impeding when turning. In addition, the inclination of the oblique arm portion is not too large in either the closed position or the open position, the tidiness of the stack of pages will not be significantly affected when the oblique arm portion is pivoted from the closed position to the open position.

What is claimed is:

1. A ring binder for retaining hole-punched pages, comprising:

a housing extending in a longitudinal direction;

a pair of pivotable hinge plates received in the housing and clamped together by the housing; and at least one pair of half ring members fixed to the pair of hinge plates respectively and moved between a closed position and an open position when the hinge plates are pivoted with respect to each other;

wherein each of the half ring members comprises:

an anchoring portion fixed to a corresponding one of the hinge plates;

a transverse arm portion having an inner end connected to an upper end of the anchoring portion and extending outwardly in a transverse direction therefrom;

an oblique arm portion having a lower end connected to an outer end of the transverse arm portion and extending obliquely and upwardly therefrom, the oblique arm portion being inwardly inclined in the closed position and outwardly inclined in the open position;

a curved portion having a lower end connected to an upper end of the oblique arm portion and extending therefrom upwardly and inwardly to form an arc section, wherein, in the closed position, upper ends of the curved portions of the pair of half ring members abut against each other in a face to face manner, and the opposite curved portions form an upwardly directed arc, and wherein the transverse arm portion comprises an inner transverse arm section and an outer transverse arm section, the inner transverse arm section is straight and extends outwardly from the anchoring portion, and the outer transverse arm section is contiguous to an outer end of the inner transverse arm section and is inclined outwardly and downwardly with respect to the inner transverse arm section.

2. The ring binder of claim 1, wherein the arc section is a circular section or an elliptic section.

3. The ring binder of claim 1, wherein the arc section is an elliptic section with a radian in the range of 30°~90°.

4. The ring binder of claim 1, wherein the arc section is a circular section with a radian in the range of 45°~85°.

5. The ring binder of claim 1, wherein the two curved portion are provided with engaging structures at their upper ends.

6. The ring binder of claim 5, wherein the engaging structures comprise serrated profiles or stepped profiles which engage with each other.

7. The ring binder of claim 5, wherein the engaging structures comprise a projection formed on the upper end of the curved portion of one of the half ring members and a recess formed in the upper end of the curved portion of the other of the half ring members for receiving the projection therein.

8. The ring binder of claim 7, wherein the size of the cross section of the projection, from the front end of the projection to the rear end of the projection, keeps constant or become gradually enlarged, and the size of the cross section of the recess, from the front end of the recess to the rear end of the recess, keeps constant or become gradually reduced.

9. The ring binder of claim 8, wherein the shape of the projection is selected from a group consisting of: a prism or a cylinder with a chamfered or rounded front end, a circular cone or a prismatic cone gradually enlarged from its front end to its rear end, a semisphere or a part of a sphere, and a semi-spheroid or a part of a spheroid.

10. The ring binder of claim 8, wherein the shape of the recess is selected from a group consisting of: a prism, a cylinder, and a circular cone or a prismatic cone gradually reduced from its front end to its rear end.

11. The ring binder of claim 1, wherein the oblique arm portion is straight.

12. The ring binder of claim 1, wherein the transverse arm portion is straight.

13. The ring binder of claim 1, wherein an inwardly inclined angle of the oblique arm portion in the closed position is smaller than a pivot angle of the half ring member between the closed position and the open position.

14. The ring binder of claim 13, wherein the inwardly inclined angle of the oblique arm portion in the closed position is one half of the pivot angle of the half ring member.

15. The ring binder of claim 14, wherein the inwardly inclined angle of the oblique arm portion is in the range of 5°~45°.

16. The ring binder of claim 13, wherein the inwardly inclined angle of the oblique arm portion is in the range of 10°~30°.

17. The ring binder of claim 13, wherein the inwardly inclined angle of the oblique arm portion is in the range of 15°~25°.

18. The ring binder of claim 1, wherein there is a smooth transition between the curved portion and the oblique arm portion of the half ring member.

19. The ring binder of claim 1, wherein an acute angle is formed between the oblique arm portion and the transverse arm portion of the half ring member.

20. The ring binder of claim 1, wherein a right angle or an acute angle is formed between the transverse arm portion and the anchoring portion of the half ring member.

21. The ring binder of claim 1, wherein the anchoring portion of the half ring member inserts through an inserting hole formed in a corresponding one of the hinge plates and is anchored thereto, at least one side surface of the anchoring portion is formed with a locating portion, and the inserting hole has a fitting portion which engages with the locating portion of the anchoring portion.

22. The ring binder of claim 21, wherein the locating portion comprises one or more locating planes.

23. The ring binder of claim 22, wherein the one or more locating planes are parallel to or perpendicular to the transverse direction.

24. The ring binder of claim 1, further comprising attaching members to be attached to a carrier for the ring binder.

25. The ring binder of claim 1, further comprising actuating levers provided at longitudinal opposite ends of the housing, each actuating lever having a driving portion engaging with inner portions of longitudinal ends of the pair of hinge plates.

26. The ring binder of claim 1, wherein a top wall of the housing is formed with reinforcement ridges which extend in the longitudinal direction.

27. The ring binder of claim 1, wherein the housing is formed with transverse cutouts which are inserted through by the half ring members, and is formed with reinforcement ribs extended in the longitudinal direction near the cutouts.

28. The ring binder of claim 1, wherein the hinge plates are each formed with reinforcement ribs which extend in the longitudinal direction and are separated.

* * * * *